US005392820A

United States Patent [19]

Seiler

[11] Patent Number: 5,392,820

[45] Date of Patent: Feb. 28, 1995

[54] PIEZOELECTRICALLY CONTROLLED LIFT BLADE AND HOOKING FOR A SHED-FORMING DEVICE FOR A LOOM

[75] Inventor: Wolfgang Seiler, Mönchengladbach, Germany

[73] Assignee: Oskar Schleicher, Monchen-Gladbach, Germany

[21] Appl. No.: 199,826

[22] Filed: Feb. 22, 1994

[30] Foreign Application Priority Data

Mar. 29, 1993 [DE] Germany ..... 4309983

[51] Int. Cl.[6] ..... D03C 3/20

[52] U.S. Cl. ..... 139/455

[58] Field of Search ..... 139/455, 59

[56] References Cited

U.S. PATENT DOCUMENTS 4,195,671 4/1980 Bossut ..... 139/455

4,969,490 11/1990 Seiler ..... 139/455

FOREIGN PATENT DOCUMENTS

WO/01337 1/1993 WIPO ..... 139/455

*Primary Examiner*—Andrew M. Falik

*Attorney, Agent, or Firm*—Mason, Kolehmainen, Rathburn & Wyss

[57] ABSTRACT

A shed forming arrangement for a loom comprises lift elements which are movable in opposite relationship to each other and hooks which are operatively associated with the lift elements. The hooks are connected in pairs by connecting members forming loops which pass around rollers operatively connected to the shedding means of the loom. Arresting elements are movable between an engagement position with the respective hook and a non-engagement position, and actuating devices influence the position of the arresting elements. The actuating devices each include a piezoelectric flexural transducer stationarily clamped at one end. The transducers are each arranged for operating movement transversely to the path of movement of the associated arresting element between a blocking position of being disposed in the path of movement of the associated arresting element and a non-blocking position of being disposed outside the path of movement of the associated arresting element.

10 Claims, 2 Drawing Sheets

Fig. 1
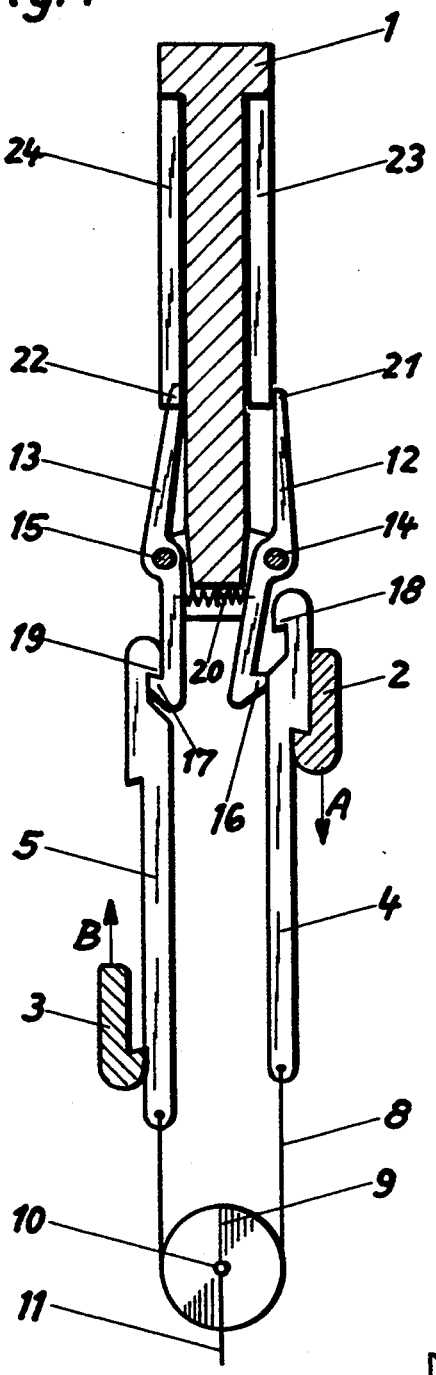
Fig. 2
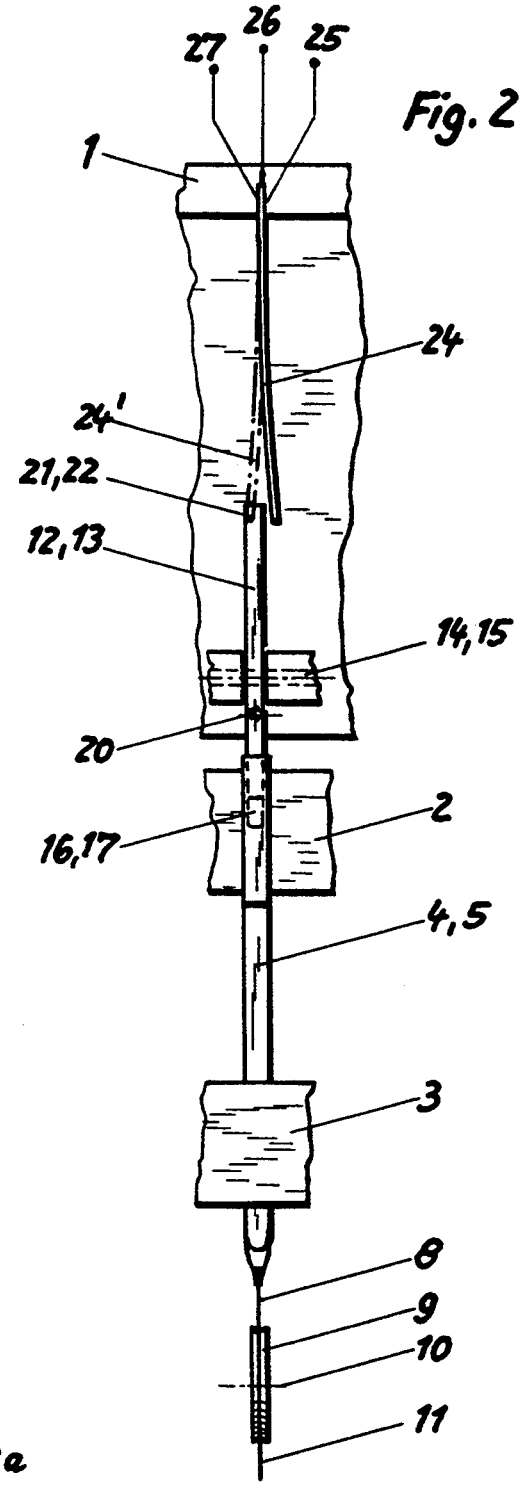
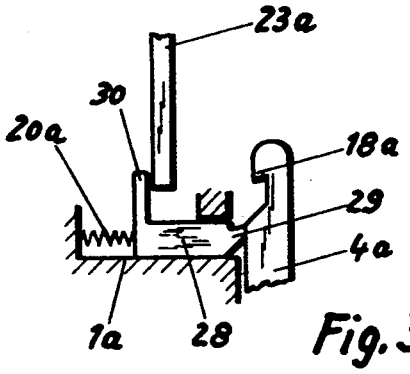
Fig. 3

PIEZOELECTRICALLY CONTROLLED LIFT BLADE AND HOOKING FOR A SHED-FORMING DEVICE FOR A LOOM

BACKGROUND OF THE INVENTION

The present invention concerns a shed forming arrangement for looms.

One form of shed forming arrangement for a loom comprises lift elements which are movable in opposite relationship to each other and hooks which are associated with the lift elements. The hooks are connected in pairs by connecting members forming loops which pass around rollers which act on the shedding means such as the heald train or harness train of the loom. Arresting elements are movable between an engagement position with the respective hook and a non-engagement position, the positions of the arresting elements being influenced by respective actuating devices which each have a piezoelectric flexural or bending transducer stationarily clamped at one end. A shed forming arrangement for a loom of that kind is known from WO 93/01337, with the piezoelectric flexural transducers disposed in such a way that they displace the arresting element, for example move thrust elements. However piezoelectric transducers are inherently not suitable for producing levels of mechanical output of useful orders of magnitude. Problems with the arrangement outlined above occur in particular for example when the arresting elements are to be moved for the first time after being stationary for a prolonged period and also if the ease of movement of the arresting elements is reduced due to soiling which has occurred, as in such situations the respective piezoelectric flexural transducer is required to produce more force than under normal operating conditions. However the transducer is unable to produce that force.

SUMMARY OF THE INVENTION

An object of the invention is to provide a shed forming arrangement for a loom having actuating elements in the form of piezoelectric flexural transducers, in which the actuation function of the transducers is independent of the mechanical power produced upon their movement.

Another object of the invention is to provide a shed forming arrangement for a loom, so designed that arresting elements for the hooks are only controlled by but not directly moved by piezoelectric flexural transducers so that the transducers operate in a load-free condition.

In accordance with the present invention the foregoing and other objects are achieved by a shed forming arrangement for a loom, comprising lift elements movable in opposite relationship to each other and hooks operatively associated with the lift elements to be selectively entrained thereby. The hooks are connected in pairs by connecting members forming loops in which respective rollers are carried. The rollers are operatively connected to the shedding means such as the heald train or harness train of the loom. Arresting elements are movable between an engagement position with the respective hook and a non-engagement position, while actuating devices are adapted to influence the positions of the arresting elements. The respective actuating devices each have a piezoelectric flexural transducer stationarily clamped at one end. The piezoelectric flexural transducers are each arranged movably transversely to the path of movement of the associated arresting element between a blocking position of being disposed in the path of movement of the associated arresting element and a non-blocking position of being disposed outside the path of movement of the associated arresting element.

In a preferred feature of the invention operatively associated with each hook is a piezoelectric flexural transducer which is movable transversely to the direction of movement of the associated arresting element. That configuration has the advantage that a plurality of piezoelectric flexural transducers can be disposed in juxtaposed relationship on an electronic circuit board.

In a further form of this preferred configuration of the invention, the arresting elements can be in the form of pivotal levers which are subjected to the effect of a biasing force in one direction of movement, while the pivotal levers each have a projection which is pivotable into the region of the hook portion of the associated hook, and a contact portion which is pivotable into a region of the path of movement of the associated pieozlectric flexural transducer. The movement of those arresting elements is effected in one direction of movement by pivotal motion by means of the hook which in turn is moved by the associated lift element, and in the other direction of movement by the action of the biasing force. Depending on whether the piezoelectric flexural transducer is moved into the blocking position or into the non-blocking position, the movement of the pivotal lever constituting the arresting element can then take place over the entire length of its possible path of movement or only until it bears against the piezoelectric flexural transducer when the latter is disposed in the blocking position.

Instead of the arresting elements being in the form of pivotal levers, in a further configuration according to the invention it can also be provided that the arresting elements may be in the form of slide portions which are subjected to the action of a biasing force in one direction of movement and the slide portions may each have a projection which is displaceable into the region of the hook portion of the associated hook and a contact portion which is displaceable into a region of the path of movement of the associated piezoelectric flexural transducer.

This embodiment can also provide that the movement of the slide portion constituting the arresting element in one direction is produced by the action of the hook which in turn is moved by way of the movement of the lift element, while in the other direction of movement it is produced by the action of the biasing force which for example can be provided by way of a compression spring.

In a further configuration according to the invention it can also be provided that associated with each pair of co-operating hooks is only a single piezoelectric flexural transducer which is movable transversely to the direction of movement of the associated arresting element. This construction has the advantage that it requires only half the number of piezoelectric flexural transducers that are required in the above-described embodiments. The amount of electronics to be employed is also correspondingly reduced. The higher level of mechanical expenditure which is involved in comparison with the configuration in which a respective piezoelectric flexural transducer is associated with each hook is lower from the economy point of view than the electrical expenditure in respect of which a saving is made.

This arrangement also enjoys the advantage that a plurality of piezoelectric flexural transducers can be disposed on a single electronic circuit board.

In a further configuration of this embodiment arresting elements may be in the form of pivotal levers which are subjected to the action of a biasing force in one direction of movement and the pivotal levers each have a projection which is pivotable into the region of the hook portion of the associated hook, and a contact portion which is pivotable into a region of the path of movement of the common piezoelectric flexural transducer, while associated with the pivotal levers which are each associated with a respective pair of hooks is a further common lift element which is disposed between said pivotal levers and which, in each movement of the lift elements moving in opposite relationship to each other, performs a lift movement between a position of lying in the range of pivotal movement of the pivotal levers and a position of lying outside the range of pivotal movement of the pivotal levers.

In this embodiment the movement of the arresting elements in one direction is again produced by the action of the biasing force which can be produced for example by a compression spring. However the movement of the arresting elements in the opposite direction is not produced by the action of the hooks but by the action of the common further lift element.

Further objects, features and characteristics of the invention will be apparent from the following description of preferred embodiments.

BRIEF DESCRIPTION OF THE DRAWINGS

FIG. 1 is a diagrammatic view in section through part of an embodiment of a shed forming arrangement according to the invention, only parts which are essential for the purposes of describing the invention being illustrated here, FIG. 2 is a diagrammatic side view of the arrangement shown in FIG. 1, FIG. 3 is a detail view of an embodiment of the arrangement according to the invention similar to that shown in FIG. 1 but having arresting elements in the form of slide portions.

DESCRIPTION OF PREFERRED EMBODIMENTS

Figure 4:
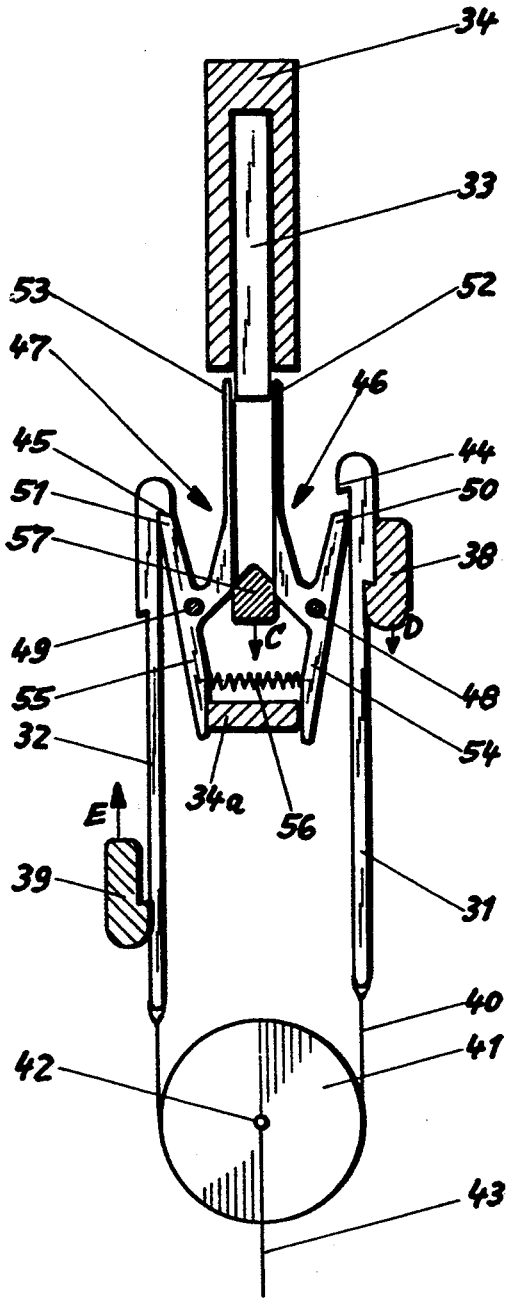
FIG. 4 is a sectional view through a further embodiment of a shed forming arrangement according to the invention, only parts which are essential for describing the invention being illustrated here.

It will be noted that in practice, in a shed forming arrangement, a plurality of the illustrated assemblies is disposed in succession and in juxtaposed relationship, that is to say for example sixteen in juxtaposed relationship and eightyfour in succession.

Referring firstly to FIGS. 1 and 2, reference numeral 1 denotes a stationary part of the machine with which there are associated lift elements 2 and 3. The lift elements 2 and 3 are in the form of lift blades which are movable in mutually opposite relationship for example from the position shown in FIG. 1 in the directions indicated by the arrows A and B respectively. The lift element 2 is shown in the top dead center position and the lift element 3 is shown in the bottom dead center position. Associated with the lift elements 2 and 3 are respective hooks 4 and 5 which at their lower ends are connected to the respective ends of a connecting member in the form of a cord 8 forming a loop in which a roller 9 runs. Arranged at the shaft 10 of the roller 9 is a connecting element 11 which acts on the shedding means such as the heald train or harness train (not shown) of a loom (also not shown).

The hooks 4 and 5 are each guided in a respective guide means (not shown). Arresting elements in the form of pivotal levers 12 and 13 are disposed on the stationary machine part 1. The pivotal levers 12 and 13 are mounted pivotably at pivot points 14 and 15. A lever arm of each of the pivotal levers 12 and 13, being the lower lever arm in FIG. 1 has a respective projection 16 and 17 respectively which is pivotable into the region of the hook portion 18 and 19 respectively of the associated hook. The two lever arms are each subjected to the action of a biasing force which is produced by a diagrammatically illustrated compression spring 20. The pivotal levers 12 and 13 further have as their other upper lever arms contact portions 21 and 22 which are pivotable about the pivot points 14 and 15 in the clockwise direction or the counter-clockwise direction in the plane of the drawing in the view shown in FIG. 1. The outer ends, which are the upper ends in the view in FIG. 1, of the contact portions 21 and 22 project into a region of the path of movement of elongate piezoelectric flexural transducers 23 and 24 which are fixedly clamped at their end which is the upper end in the view shown in FIG. 1 and 2, while the lower end of each thereof, in the view shown in FIG. 1, is movable into and out of the plane of the drawing. Accordingly the direction of movement of the free ends of the piezoelectric flexural transducers 23 and 24 is disposed transversely to the direction of movement of the contact portions 21 and 22.

FIG. 2 additionally shows the electrical terminals of one of the piezoelectric flexural transducers, namely the flexural transducer 24, the terminals being identified by references 25, 26 and 27. FIG. 2 shows in solid lines a deflected pivotal position of the piezoelectric flexural transducer 24, in which it lies outside the path of movement of the associated arresting element 13. In comparison, shown in dash-dotted lines and identified at 24' is a blocking position of the piezoelectric flexural transducer in which it would be disposed in the path of movement of the associated arresting element 13.

The movement of the arresting elements 12 and 13 is effected in one direction by the action of the compression spring 20 and in the other direction by the action of the hooks 4 and 5. FIG. 1 shows a position in which the lift element 2 is in the upper motion-reversal position, having entrained the hook 4 upwardly. The hook 4 has pivoted the pivotal lever 12 in the clockwise direction against the force of the compression spring 20, by making contact against the projection 16, into the position shown in FIG. 1 in which the contact portion 21 has moved into a position outside the path of movement of the piezoelectric flexural transducer 23. The piezoelectric flexural transducer 23 can freely oscillate in that position, that is to say, in the view shown in FIG. 1, it can move perpendicularly out of the plane of the drawing or into the plane of the drawing (or in the view shown in FIG. 2 it can move in the plane of the drawing), that is to say, it is movable between the blocking position and the non-blocking position.

When the lift blade 2 is moved downwardly in the direction indicated by the arrow A, the projection 16 moves into the region of the hook portion 18 of the hook 4 when the piezoelectric flexural transducer 23 assumes the non-blocking position. In that case the hook 4 would then be supported with the hook portion 18 on the projection 16 of the pivotal lever 12 (as is shown in FIG. 1 in respect of the hook 5).

If however on the other hand, the piezoelectric flexural transducer 23 is in the blocking position, upon a downward movement of the lift blade 2 in the direction indicated by the arrow A the pivotal lever 12 would move only slightly in the counter-clockwise direction, more specifically only until the contact portion 21 bears against the piezoelectric flexural transducer 23 which is disposed in the blocking position. In that case however the hook 4 cannot engage the projection 16 with its hook portion 18, and the hook 4 moves downwardly jointly with the lift blade 2.

The same sequence of movements takes place on the left-hand side in FIG. 1, and for that reason those movements will not be described separately once again.

Looking now at FIG. 3, the arrangement shown therein only differs in principle from the arrangement shown in FIGS. 1 and 2 in that the arresting elements are not in the form of pivotal levers (12 and 13 in FIGS. 1 and 2) but in the form of slide portions of which only a single slide portion is illustrated in FIG. 3 and identified by reference numeral 28. The slide portions each have a projection 29 and a contact portion 30. The remainder of the parts illustrated in FIG. 3, which correspond in principle to the construction shown in FIGS. 1 and 2, are denoted by the reference numerals used therein, in each case with the addition of the letter 'a'. The operating procedure involved with the arrangement shown in FIG. 3 corresponds to that of the arrangement shown in FIGS. 1 and 2, except that the slide portions 28 are moved in one direction by the compression spring 20*a* and in the other direction by the action of the hook 4*a* which, by virtue of bearing against the projection 29, moves the respective slide portion 28 against the force of the compression spring 20*a* (towards the left in FIG. 3). The respective piezoelectric flexural transducer, here identified by reference 23*a*, is movable transversely to the direction of movement of the slide portion 28 and therefore perpendicularly to the plane of the drawing.

Figure 5:
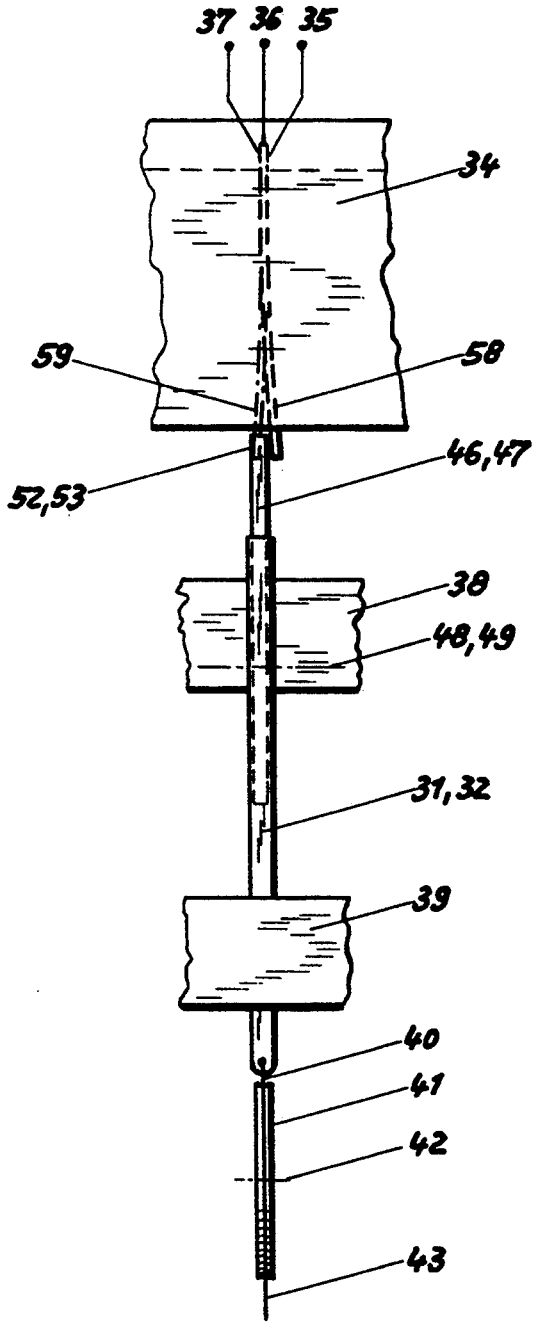
FIG. 5 is a diagrammatic side view of the arrangement shown in FIG. 4.

The further embodiment shown in FIGS. 4 and 5 differs in principle from the embodiments described above in that only a single piezoelectric flexural transducer is associated with each pair of hooks. Thus reference numeral 33 in FIG. 4 identifies a single piezoelectric flexural transducer operatively associated with the pair of hooks identified by references 31 and 32 in FIGS. 4 and 5. The transducer 33 is mounted to a stationary machine part 34, with its end which is the upper end in FIG. 4. The electrical terminals of the transducer 33 are identified by references 35, 36 and 37. The lift blades are here identified by references 38 and 39. The hooks 31 and 32 are each connected at their lower ends to the respective ends of a corresponding member in the form of a cord 40 forming a loop in which a roller 41 runs. Arranged at the shaft 42 of the roller 41 is a connecting element 43 which acts on the shedding means, for example the heald train or harness train (not shown) of a loom (also not shown).

A further stationary machine part which is disposed between the hooks 31 and 32 and connected to the machine part 34 is identified by reference 34*a*. The hooks 31 and 32 have hook portions 44 and 45.

The arrangement also has arresting elements 46 and 47 which, as can be seen from FIG. 4, are in the form of pivotal levers which are pivotable in the plane of the drawing about pivot points 48 and 49, as shown in FIG. 4. The pivotal levers 46 and 47 each have a projection 50 and 51 respectively which is pivotable into the region of the hook portion 44 and 45 of the respectively associated hook 31 and 32, and a respective contact portion 52 and 53 pivotable into the path of movement of the common piezoelectric flexural transducer 33. The pivotal levers 46 and 47 also have further lever arms 54, 55 which can be supported against the stationary machine part 34*a* in the position shown in FIG. 4, and to which a compression spring 56 also applies a bising force urging the lever arms 54, 55 away from each other. Accordingly the pivotal lever 47 which is shown at the left in FIG. 4 can be moved in the clockwise direction by the action of the compression spring 56 while the pivotal lever 46 which is shown at the right in FIG. 4 can be moved in the counter-clockwise direction by the force of the compression spring 56. The movement of the arresting elements 46 and 47 in the respective other directions is produced by the action of a further common lift element 57 which is disposed between the pivotal levers 46 and 47 and which is movable in the direction indicated by the arrow C between the upper limit position shown in FIG. 4 and a lower limit position in which the sides of the further lift element 57 no longer bear against the associated pivotal levers. In that position the pivotal levers 46 and 47 can be pivoted by the action of the compression spring 56, more specifically when the piezoelectric flexural transducer 33 is in a non-blocking position. The non-blocking position is shown in broken line in FIG. 5 and identified by reference numeral 58. In comparison the blocking position is shown in dash-dotted line and identified by reference numeral 59.

In the view shown in FIG. 4 the lift element 38 in the form of a lift blade has moved upwardly and has moved the hook 31 into the upper limit position. At the same time the further lift element 57 has been moved upwardly in the opposite direction to the direction indicated by the arrow C, into the upper limit position shown in FIG. 4. In that position the path of movement of the piezoelectric flexural transducer 33 is free, that is to say the contact portions 52 and 53 do not bear against the lower end region of the piezoelectric flexural transducer 33. The piezoelectric flexural transducer 33 can now be freely moved either into the blocking position or into the non-blocking position, that is to say perpendicularly to the plane of the drawing in the view shown in FIG. 4.

The further lift element 57 now moves in approximately synchronised relationship with the lift element 38 downwardly in the direction indicated by the arrow C, as the lift element 38 moves downwardly in the direction indicated by the arrow D. In that movement, the assembly reaches a position in which the further lift element 57 no longer bears with its side regions against the pivotal levers 46 and 47. That then has the consequence that the contact portion 52 is pivoted in the counter-clockwise direction. If the piezoelectric flexural transducer 33 is in the blocking position 59, the contact portion 52 bears against the piezoelectric flexural transducer 33 and accordingly can perform only a very short movement in the counter-clockwise direction. In that case, upon a further downward movement of the lift element 38 in the direction indicated by the arrow D, and with the accompanying downward movement of the hook 31, the hook portion 44 would engage the projection 50 of the pivotal lever 46 and the hook 31 would remain in an upper position. That upper position is shown in FIG. 4, in respect of the hook 32.

If in comparison, in the above-indicated situation, the piezoelectric flexural transducer 33 is pivoted into the non-blocking position, the contact portion 52 and therewith the entire pivotal lever 46 would be pivoted in the counter-clockwise direction by the action of the compression spring 56 until the projection 50 moves outside the region of the hook portion 44 of the hook 31. The consequence of that would be that the hook 31 moves downwardly upon downward movement of the lift element 38.

When the lift element 39 moves upwardly in the direction of the arrow E, it will lift the hook 32 out of the illustrated position until the position shown at the right-hand side in FIG. 4 in respect of the hook 31 is reached. The cycle can then be repeated.

It will be noted that, instead of the further lift element 57 it would also be possible for example to provide a rotating element of eccentric configuration.

It will thus be seen from the foregoing that in the described shed forming arrangements for looms the piezoelectric flexural transducers are therefore so arranged that they can oscillate freely or move freely between relevant positions, without simultaneously moving a load. The actuation effect is achieved by virtue of the fact that the path of movement of the associated arresting element is either blocked or not blocked by the piezoelectric flexural transducers which are movable freely, that is to say without load, so that movement of the arresting element is not effected by the action of the respective piezoelectric flexural transducer but independently thereof.

The movement of the piezoelectric flexural transducers transversely to the path of movement of the associated arresting elements takes place in each case when they are 'free', that is to say in a position in which no arresting element bears against the respective piezoelectric flexural transducer. As the movement of the arresting elements is not derived from the movement of the piezoelectric flexural transducers but from the hook movement of the applied biasing force respectively, the forces which have to be applied for example for 'starting up' after a prolonged stoppage period and which are greater than the forces that are normally to be applied, or the greater forces which have to be applied in the event that the arresting elements are less easy to move as a result of fouling or contamination can be applied without any problem by way of the hook movement or the biasing force respectively, without the control function or control effect of the piezoelectric flexural transducers being in any way adversely affected thereby.

It will be appreciated that the above-described embodiments of the invention have been set forth solely by way of example and illustration thereof and that various modifications and alterations can be made therein without thereby departing from the spirit and scope of the invention.

What is claimed is:

1. A shed forming arrangement for a loom, comprising: lift elements movable in opposition relationship to each other; hooks adapted to be operatively associated with the lift elements; a connecting member connecting each two adjacent hooks to form a respective pair, each connecting member forming a loop; a roller carried in each loop; means connecting said roller to shedding means of the loom; arresting elements movable between an engagement position with the respective hook and a non-engagement position; and actuating devices adapted to influence the position of the respective arresting elements, each actuating device comprising a piezoelectric flexural transducer and means for stationarily clamping same at one end thereof to a stationary machine part, each piezoelectric flexural transducer being arranged so that its free end moves transversely to the path of movement of the associated arresting element between a blocking position of being disposed in the path of movement of the associated arresting element and a non-blocking position of being disposed outside the path of movement of the associated arresting element.

2. A shed forming arrangement as set forth in claim 1 wherein a piezoelectric flexural transducer is associated with each hook.

3. A shed forming arrangement as set forth in claim 2 wherein the arresting elements are in the form of pivotal levers each having a projection which is pivotable into the region of the hook portion of the associated hook and a contact portion which is pivotable into a region of the path of movement of the associated piezoelectric flexural transducer, and further including a biasing means urging the respective pivotal levers in one direction of movement.

4. A shed forming arrangement as set forth in claim 3 wherein said biasing means is a compression spring.

5. A shed forming arrangement as set forth in claim 2 wherein the arresting elements are in the form of slide portions each having a projection which is displaceable into the region of the hook portion of the associated hook and a contact portion which is displaceable into a region of the path of movement of the associated piezoelectric flexural transducer, and further including a biasing means urging the respective slide portion in one direction of movement.

6. A shed forming arrangement as set forth in claim 5 wherein said biasing means is a compression spring.

7. A shed forming arrangement as set forth in claim 1 comprising only a single piezoelectric flexural transducer associated with each said pair of hooks.

8. A shed forming arrangement as set forth in claim 7 wherein the arresting elements are in the form of pivotal levers each having a projection which is pivotable into the region of the hook portion of the associated hook and a contact portion which is pivotable into a region of the path of movement of the common piezoelectric flexural transducer, and further including: a biasing means urging the respective pivotal levers in one direction of movement; and a further common control element operatively associated with the pivotal levers which are each associated with a respective pair of hooks, the further common control element being disposed between said pivotal levers and being adapted in each movement of the lift elements movable in opposite relationship to each other to perform a control movement between a position of lying in the range of pivotal movement of the pivotal levers and a position of lying outside the range of pivotal movement of the pivotal levers.

9. A shed forming arrangement as set forth in claim 8 wherein said biasing means is a compression spring.

10. A shed forming arrangement as set forth in claim 8 wherein said further common control element is a further common lift element.

* * * * *